US005556090A

United States Patent [19]

Coleman

[11] Patent Number: 5,556,090

[45] Date of Patent: Sep. 17, 1996

[54] KIT FOR BASEBALL FIELD

[76] Inventor: Jeffrey Coleman, 15 W. 84th St., New York, N.Y. 10024

[21] Appl. No.: 524,222

[22] Filed: Sep. 6, 1995

[51] Int. Cl.[6] ..... A63B 71/00

[52] U.S. Cl. ..... 273/25; 273/411; 273/DIG. 30

[58] Field of Search ..... 273/25, 27, 31, 273/411

[56] References Cited

U.S. PATENT DOCUMENTS

| | | | |
|---|---|---|---|
| 3,393,913 | 7/1968 | Safina | 273/411 |
| 3,971,558 | 7/1976 | Gardetto | 273/25 |
| 4,309,031 | 1/1982 | O'Meara | 273/25 |
| 4,398,715 | 8/1983 | Hall | 273/DIG. 30 |
| 4,844,478 | 7/1989 | Kessler | 273/411 |
| 5,000,448 | 3/1991 | Anderson | 273/25 |
| 5,141,232 | 8/1992 | Durso | 273/DIG. 30 |

*Primary Examiner*—Theatrice Brown
*Attorney, Agent, or Firm*—Evelyn M. Sommer; Skadden, Arps, Slate, Meagher & Flom

[57] ABSTRACT

A kit provided for putting in place a regulation size baseball field in a suitably sized park, playground, pasture, sandlot or the like. The components of the kit are contained in a small compact duffle bag and comprise in addition to the bag, 3 regulation size bases, home plate, pitcher's plate, Velcro patches approximately 2 - 4" X 2 - 4", 5 metal stakes, a measuring tape marked along its length at 60 feet 6", 90 feet, and 127 feet 3⅜". Preferably there is included in the kit, a brush for cleaning off home plate, an instruction sheet and a ball. The field is the regulation 90 foot square, with home plate, first, second and third base occupying the corners of the squares. Second base is 127 feet 3/3;8" from home plate, and the pitcher's plate 60 feet 6" from home plate along the same line of measurement. Each of the bases and plates has fixedly attached to the back surface thereof a Velcro patch with the fastening means facing out. In erecting the field, one of the 5 loose patches is placed on the ground at what will be the four corners of the square and the pitcher's plate on the pitcher's mound, each site of placement having been predetermined by measurements made using the measurement tape. The Velcro patches have their fastening surface facing up and are secured in place by means of one of the stakes. The plate or base is then attached to the Velcro patch by placing it over the Velcro patch which has been secured to the ground so that its Velcro patch mates with the secured patch and pressing.

14 Claims, 2 Drawing Sheets

KIT FOR BASEBALL FIELD

FIELD OF THE INVENTION

This present invention relates to a kit which contains all of the required equipment and/or parts to bring into existence a regulation sized baseball playing field regardless of the location thereof, as for example, in a park, playground, school yard, sand lot, etc.

There is hardly anyone who has not participated in a baseball game, either as a player, umpire, team manager or coach or as an observer. Baseball is most popular in the United States, where it originated, in Latin-American countries including Mexico and Cuba and in Japan. It is traditionally the U.S. national pastime, the game of summer. The game is played informally by school children on playgrounds and in parks and more formally in regular leagues for players ranging from eight to eighteen. It is played by teams representing grade schools, high schools, prep schools, colleges, universities, business and industrial companies and churches, and also by teams representing service units of the armed forces. Children are introduced to baseball at a very young age and continue to play the game through adolescence and thereafter.

Amateur baseball thrives on vacant lots and playgrounds in towns and cities and on pastures and open fields in the country.

The first national amateur baseball program was the American Legion Junior League, founded in 1926, later called the American Legion Baseball League, with an upper age limit of 17 (18 from 1960).

The American Amateur Baseball Congress, founded in 1935, conducts baseball programs for youths from the age of 8 to 19. Little League, founded in 1939 and originally for boys 8 to 12 years old, account for more than 2,500,000 players in the United States since the early 1980s. Two additional divisions for boys up to 18 were later added, and in 1974 girls were admitted to play. Other organized league for young players included the Babe Ruth League, founded in 1952, and PONY (Protect Our Nation's Youth) Baseball, Inc.

By the 1980s more than 1,000 colleges fielded baseball teams under the governance of the National Collegiate Athletic Association, which in 1963 led in the forming of the U.S. Baseball Federation, representing all amateur groups. From 1972, it has conducted a collegiate world series with teams selected by its Japanese equivalent. Play by military service teams made baseball a minor sport in The Netherlands, Italy, Belgium, England, Spain, Australia and Tunisia.

The young players who are not part of an organized league mostly play in pickup games, school offered recreational games and the like. In most instances, the field for playing which is available to them is a playground, park, sandlot or other open space. The bases, home plate and pitcher's plate are improvised and can be rocks of convenient size, pieces of plywood or any available item that can serve as a visible marker for designating a base or plate. The distance between each of the bases, home plate and the bases, the pitcher's plate and home plate are determined by pacing off, each pace having been preset as approximating two to three feet. In some instances where the team is sponsored by a business or industrial company or the players are part of a well-to-do suburban team, the team may possess bases and plates which constitute heavy sand filed sealed canvas bags. These heavy bases and plates are carted to and from the playing field, as are the players, the bats, balls and gloves by a parent, coach or team manager. However, urban park playground and sandlot players rarely have the luxury of bases and plates or the place to store them and rely in the main on the aforementioned markers. In connection with the sand filled or other heavy material filled bases, it should be noted and this is particularly true where young children are involved, and where as is conventional, the bases are affixed to the ground, there is the disadvantage that a player's toes can come in contact with the edge of the base or possibly his foot can extend under the leading edge of the base, in either case abruptly interrupting the running motion of the player and causing injury. This is particularly the result of the unyielding nature of the heavy material filled base and the fact that it is fixed to the ground.

Furthermore, the purchase of these official type bases and plates is costly and accordingly not an option available to many young players.

Finally, the transport and storage of the heavy bases poses a problem to the players and/or their team coaches and managers.

In regulation baseball, four bases (three bases and home plate) are laid out at angles of a 90 foot square. The distance between home plate and each of first and third base respectively is 90 feet, and the distance between second base and first and third base respectively is also 90 feet. The distance between home plate and the pitcher's plate is 60 feet 6", and the distance between home plate and second base is 127 feet 3 3/8 ".

It is apparent that children or young players in a neighborhood park, playground, open pasture or other field have no means at their disposal for making the measurements just described. At best this is done by pacing off with each pace taken as equal to a predetermined distance, for example depending on the pacer's stride as equal to 2 feet or 3 feet or something in between and the field laid out accordingly. Alternatively, the field can be laid out by eyeballing with the hope that a field of the prescribed dimensions is obtained.

It is thus apparent that there exists a need and the means for placing in position a regulation baseball field where none now exists which can be easily brought into existence and taken up before and after a game is played.

It is therefore an object of this invention to provide a kit containing all of the components, bases, home plate and the pitcher's plate and as well the means for accurately establishing the distance between them so as to bring into existence a regulation playing field irrespective of its location.

It is a further object to provide such a kit including the means for removing and attaching the bases and plates to the ground.

Still another object of the invention is to provide bases and plates in such kit which when attached to the ground are not likely to give rise to injury.

It is yet a further object of the invention to provide a kit which, when all the parts are assembled in a carrying container or bag, is light in weight and can be easily carried by even a young child.

Yet another object of the invention is to provide a kit for placing in position a regulation baseball playing field which is inexpensive to produce, can be sold at a low price, is reusable and under the usual play circumstances does not require replacement of the component parts.

Accordingly, it is to the provision of such a kit that the present invention is primarily directed.

In accordance with the invention, a kit for use in placing in position a regulation baseball field on a suitably dimensioned playground, park, sandlot, school yard, open field or the like is provided comprising:

1) 3 regulation size bases;

2) 1 regulation size home plate;

3) 1 regulation size pitcher's plate, (each of said bases and plates having fixedly attached to one side thereof a Velcro patch);

4) 5 base and/or plate attachment means for use in securing the bases and/or plates to the grounds comprising 5 Velcro patches corresponding in size to the Velcro patches affixed to the bases and/or plates and 5 stakes or nails;

5) 1 measuring tape or heavy denier string provided with markings along the length thereof corresponding to the following measurements: 60 feet 6", 90 feet and 127 feet 3⅜";

6) a bag or container of sufficient size to accommodate the foregoing items;

Optionally there can be included 7) a brush for dusting off home plate;

8) a regulation or game rule book;

9) a regulation baseball; and 10) an additional Velcro patch and stake to be used in securing the pitcher's plate to the ground.

The three bases, home plate and the pitcher's plate will have affixed to the side thereof which will be in contact with the ground, patches of Velcro which have been applied so that they will mate with the corresponding sized Velcro patches which will be secured to the ground with the metal or plastic stakes or nails.

The bag or container for holding the items constituting the kit can be made of canvas, heavy duty cotton, nylon, synthetic or natural leather or any other like material. It can be constructed as a duffle bag, a plumber's bag, tote bag or the like. A preferred construction is a duffle bag of canvas, nylon, heavy duty cotton or like material, measuring approximately 15" in length and having end sections approximately 7" in diameter and which is provided with zipper, Velcro or lace closure means.

The bases, home plate and pitcher's plate are regulation size, preferably made of canvas or other heavy duty, wear-resistant material. The filling material is selected so as to provide a soft, yielding base so that if a player stubs his toes against the base or plate or if his foot should be lodged beneath the same, the base will give way or in the alternative, fold back upon itself, substantially reducing the possibility of injury to the player.

The bases or plates have fixedly applied at the side thereof which will face the ground, using adhesive or stitching, patches of Velcro of from about 2" to 4" by about 2" to 4" in size. These patches are more or less centrally located on the surface of the base with the Velcro attaching means facing outwardly. These patches are designed for mating with the Velcro patches separately included in the kit and which will be placed on the ground and fastened thereto with the provided metal stakes or nails. The stakes or nails are approximately 3" to 6", in length, and have a flattened head portion and a tapering entering portion for facilitating their introduction through the patch and into the ground. Preferably the Velcro patches are provided with centrally located openings of about ½-⅜" in diameter also for facilitating placement and delivery of the stake.

The measuring or marker tape can be a flat tape or heavy duty string, cord or rope. It is marked along its length with readily visible indications to show the distances 60 feet 6", 90 feet and 127 feet 3⅜". The tape is conveniently wound up on a spool or spindle and is preferably provided with a metal or plastic tip means at its leading edge for facilitating its use.

When a game is to be played and a site has been selected for the playing field, the following procedure is followed.

A Velcro patch which will serve as a base or plate fastener is placed on the ground where it is desired to locate home plate. The Velcro patch is placed so that the fastening surface faces up and the patch is secured to the ground by introducing the nail or stake through the opening provided in the patch and then driving the nail or stake into the ground. Home plate is then placed over the Velcro patch now secured to the ground so that the Velcro patch carried on the back side thereof is in abutting relationship with the Velcro patch on the ground and the two Velcro patches fastened by pressing on the exposed surface of home plate.

The tip of the measuring tape is now placed on home plate and run on a line (first base line) and at a right or 90" angle along the playing field until the 90 foot mark has been reached and the procedure afore-described for fixing home plate to the ground repeated for first base.

In the same manner, third base is established by measuring off 90 feet from home plate along the third base line and repeating the step for securing of the base.

The location of second base is arrived at by completing the diamond or square and specifically by measuring a third 90 foot distance from either first or third base and repeating the placement and securing second base.

The last step is the placement of the pitcher's plate on the pitcher's mound. This is accomplished by first using the measuring tape to confirm that second base has been located 127 feet and 3⅜", from home plate. After this has been established, the tape is used so as to locate the pitcher's plate at 60 feet 6", from the rear of home plate on the line between home plate and second base. The pitcher's plate is then secured exactly as were the other bases. In accordance with one embodiment of the invention, the pitcher's plate is secured to the ground utilizing an additional Velcro patch and stake. Using this simple procedure and minimum parts a regulation field has been placed in position.

The invention and its objects and advantages will become more apparent by referring to the accompanying drawings and to the ensuing detailed description of the preferred embodiment.

Figure 1:
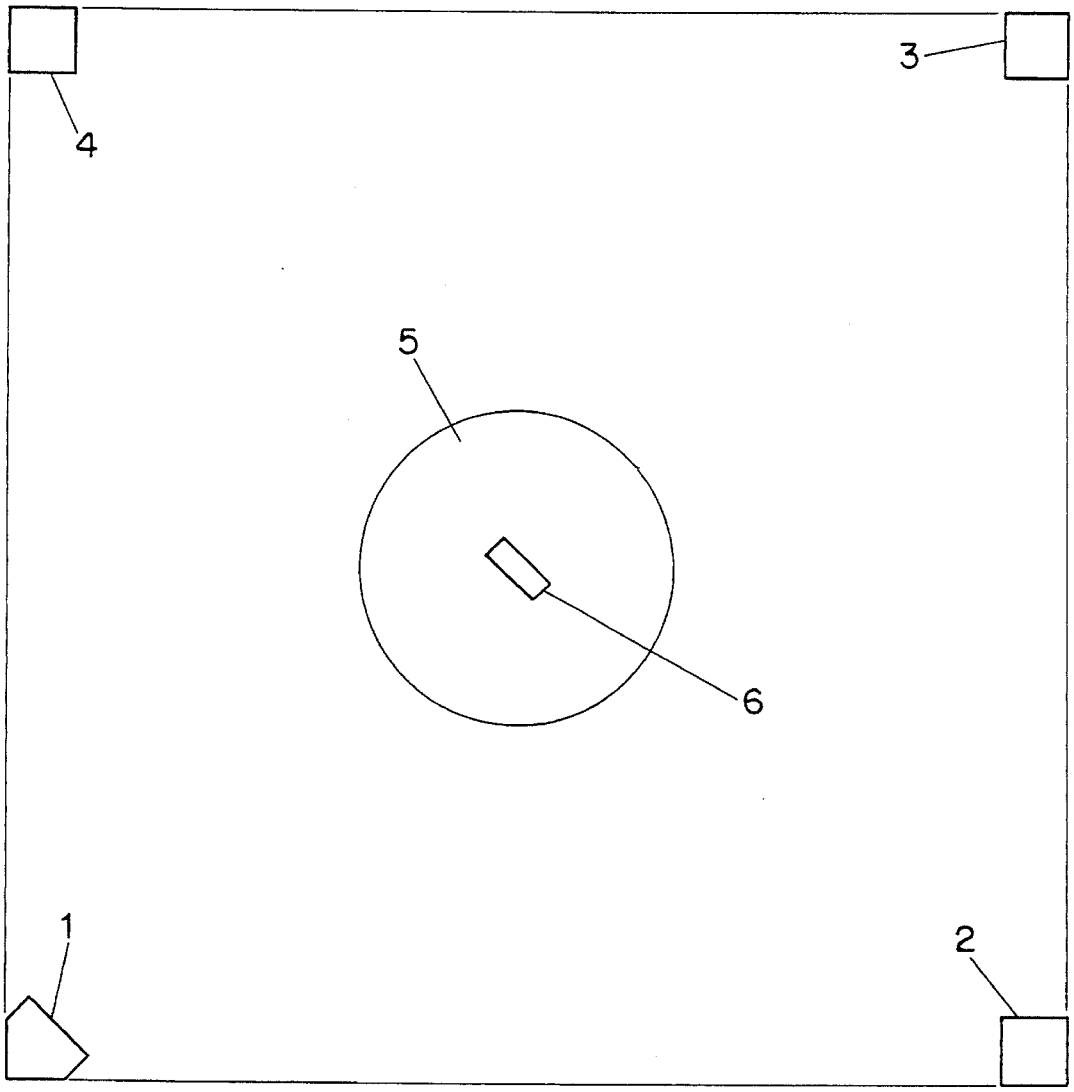
FIG. 1 is a layout of a representative baseball field.
Figure 2:
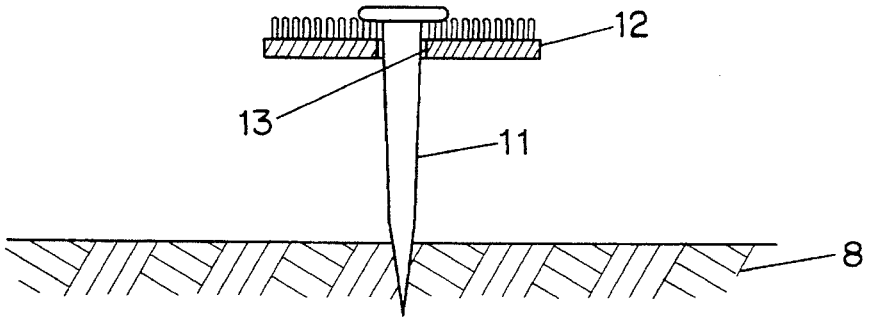
FIG. 2 is an exploded cross-sectional view showing the attachment of the Velcro patch to be ground.
Figure 3:
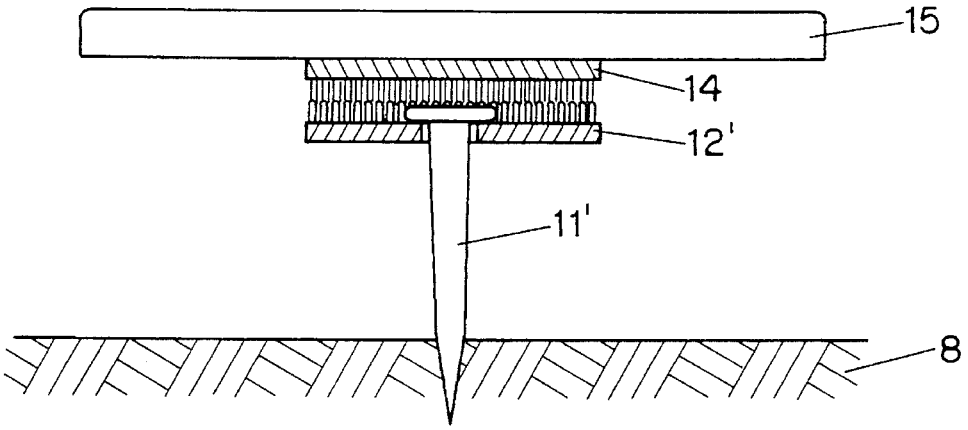
FIG. 3 is an exploded cross-sectional view showing the securing of the base or plate to the Velcro patch of FIG. 2.
Figure 4:
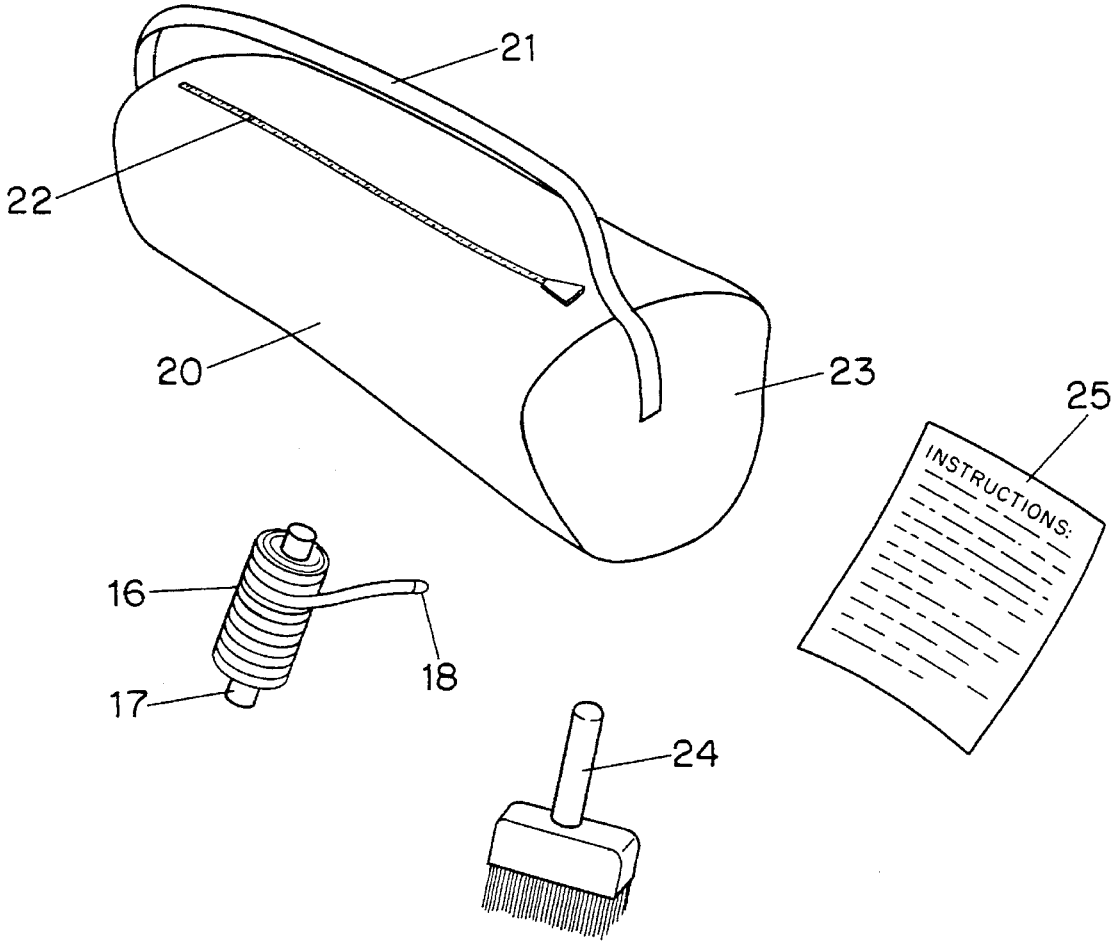
FIG. 4 shows the kit and namely the empty bag, the tape, brush and instruction sheet.

The playing field is shown in FIG. 1. Canvas bags filled with soft material and attached as hereinafter described by metal stakes driven into the ground mark first, second and third base (2, 3 and 4 respectively). Home plate is another canvas bag filled with soft material and is similarly attached to the ground. The distance between home plate and second base is 90 feet as is the distance between home plate 1 and third base 4, and the distance between second base and either of first and third base. The second base 3 is located at a distance of 127 feet 3⅜" from home plate and measured on a diagonal line extending from the respective center of home plate and pitcher's mound 5. The pitcher's plate 6 is located on that same diagonal line. The distance from home plate to the pitcher's plate is 60 feet 6". The pitcher's plate 6 is also constructed of canvas and filled with a soft material. It may be rectangular in shape as compared to the base and home plate and measures from about 3–6", in width and 12–18" in length. It too, is secured to the ground in the same manner as the three bases and home plate. The foul lines while they do not have to be established would be extended a distance from home plate on a line through third base and from home plate on a line through first base. This field corresponds to a regulation field. Referring now to FIGS. 2 and 3, the means for attaching the bases and plates to the ground is shown in some detail. The Velcro patch which in this instance is approximately 3" X 3" and has an opening about ½" in diameter located in the center thereof is placed on the ground at the place where the base is to be located, i.e., 90 feet from home plate in the case of first base, with the flat or non-attachment portion of the Velcro patch abutting the ground. The metal stake 11 which is approximately 4" long and has a flat head portion which has a diameter greater than that of the opening in the patch, is then driven through the opening into the ground so that the patch 12 described in connection with FIG. 3 is secured to the ground. The patch 14 is in this instance has been affixed by sewing to the canvas and so that the Velcro threads for mating with the threads of corresponding patch 12, are exposed. Adhesive could be substituted to good advantage for the sewing. The Velcro patch 12 is applied to the ground, at the spot indicated by measurement, the stake 11 driven through the patch and the base or plate 15 placed thereover so that the two Velcro patches interlock.

In accordance with the embodiment of the invention, there is provided means for containing the above described components comprising a conventional canvas duffle bag approximately 17" in length, having end portions of about 8" in diameter. The bag is closed by means of a zipper closure 22 and has a handle 27. The bag includes in addition to the 3 canvas bases, a canvas home plate and a pitcher's plate as described above, a measuring tape 18 and a brush 24 for brushing loose sand, etc., off home plate and an instruction sheet 25.

The distances between the bases and plates are determined by means of the measuring tape 18 wound up in this instance on a wooden or cardboard spindle 17. The leading edge of the tape is in the form of a metal or plastic tip 18. The tape carries markings at 60 feet 6", 90 feet and 127 feet 3⅜". The instruction sheet 25 include a layout of a representative base ball field and instructions pictured for carrying out the measurements, placing and fastening the Velcro patches to the ground, and for attaching the bases and plates.

The site is selected, for example, park, lawn or a field behind the school, sand lot or the like. The approximate orientation of the field decided and the instructions followed for setting up the ball field. Four bases are laid out at angles of a 90 foot square at one end of the field and a pitcher's mound located on a line between home plate and second base. When the game has been completed, the bases and plates are separated from the attachment patches remaining on the ground, the stakes withdrawn and the patches lifted off from the ground, and all of the items are returned to the duffle bag for subsequent use.

The kit makes possible the repeated rapid and accurate installation of a regulation ball field. It is light in weight, safe, and economically put together from readily available materials, canvas, Velcro, metal nails or stakes, tape or rope appropriately marked.

The kit may also include a ball not shown.

I claim:

1. A kit for use in bringing into existence a regulation size baseball field comprising:

(a) 3 regulation size bases having Velcro patches fixedly attached to a flat surface of each of said basis;

(b) 1 regulation size home plate having a Velcro patch fixedly attached to a flat surface thereof;

(c) 1 regulation size pitcher's plate having a Velcro patch fixedly attached to a flat surface thereof;

(d) 5 Velcro patches;

(e) 5 metal stakes;

(f) 1 measuring tape provided with marks along the length thereof at 60 feet 6", 90 feet and 127 feet 3⅜"; and (g) a bag for containing (a)–(f).

2. A kit according to claim 1 wherein said Velcro patches fixedly attached to said bases and plates are from 2" to 4" X 2" to 4" in size.

3. A kit according to claim 1 wherein said Velcro patches (d) are from 2" X 4" X 2" to 4" in size.

4. A kit according to claim 3 wherein each of said Velcro patches (d) has a central opening for receiving one of said stakes.

5. A kit according to claim 1 wherein each of said stakes is about 3½" to about 4½" in length, has a flat head portion on one end thereof and a tapered leading head portion on the opposite end thereof.

6. A kit according to claim 1 wherein said measuring tape is would up on a spindle.

7. A kit according to claim 1 wherein said measuring tape is provided with a metal or plastic tip at its leading edge.

8. A kit according to claim 1 additionally including a brush for dusting off home plate.

9. A kit according to claim 1 additionally including an instruction sheet providing directions for placing in position the baseball field.

10. A kit according to claim additionally including a regulation baseball.

11. A kit according to claim 1 additionally including a brush for dusting off home plate, a regulation baseball and an instruction sheet providing instructions for placing in position the baseball field.

12. A kit according to claim 1 containing an additional Velcro patch and metal stake.

13. A kit according to claim 11 wherein said bag is a duffle bag.

14. Method for bringing into existence a regulation baseball field using the kit according to claim 1 which comprises the steps of placing one of said Velcro patches on the ground with the attachment part thereof facing away from the ground at the spot where home plate will be installed, driving one of said stakes through said patch so that the patch is securely fastened to the ground, placing home plate on said patch so that Velcro patch carried thereon is in abutting contact with the Velcro patch fastened to the ground, placing three additional Velcro patches on the ground and fastening them to the ground using three additional stakes so as to form therewith a 90 foot square, using the measuring tape for establishing the 90 foot distance between home plate and first and third base and between first and second base, securing the three bases to the corresponding patches, measuring the distance between home plate and second base to confirm that the distance measures 127 feet 3⅜", adjusting the patch and location of second base if necessary, locating the last Velcro patch at a distance of 60 feet 6", measured along the line running between home plate and second base, securing the pitcher's plate to said last Velcro patch which has also been secured to the ground with a stake whereby there is established a regulation baseball field.

* * * * *